US010094615B2

(12) United States Patent
O'Gary

(10) Patent No.: US 10,094,615 B2
(45) Date of Patent: Oct. 9, 2018

(54) BIN SYSTEM AND METHOD OF REGULATING PARTICULATE FLOW FROM BINS

(71) Applicant: Gregory Howard O'Gary, Benton, AR (US)

(72) Inventor: Gregory Howard O'Gary, Benton, AR (US)

( * ) Notice: Subject to any disclaimer, the term of this patent is extended or adjusted under 35 U.S.C. 154(b) by 642 days.

(21) Appl. No.: 14/289,088

(22) Filed: May 28, 2014

(65) Prior Publication Data

US 2015/0345863 A1 Dec. 3, 2015

(51) Int. Cl.

| | |
|---|---|
| ***F26B 5/14*** | (2006.01) |
| ***F26B 3/00*** | (2006.01) |
| ***F26B 9/06*** | (2006.01) |
| ***F26B 5/00*** | (2006.01) |

(Continued)

(52) U.S. Cl.

CPC ..... *F26B 9/063* (2013.01); *F26B 5/00* (2013.01); *F26B 25/001* (2013.01); *F26B 25/10* (2013.01)

(58) Field of Classification Search

CPC .. F26B 5/00; F26B 9/063; F26B 25/10; F26B 25/001; F26B 3/08; F26B 25/008; B01J 8/24; E04H 7/00; F16K 7/071; F16K 7/075; F16K 7/17; F16K 7/07; F16K 7/10

USPC ..... 34/401, 397, 509, 511, 164, 165, 168, 34/181, 218, 242, 417; 277/304, 305, 277/306, 307, 309, 311, 628; 206/467; 137/268, 269, 270, 315, 414, 510, 225; 52/197; 251/5, 61.1

See application file for complete search history.

(56) References Cited

U.S. PATENT DOCUMENTS 2,769,397 A * 11/1956 Bolger ..... F16K 7/07 251/5
3,913,238 A * 10/1975 Updegrove ..... F26B 11/12 34/181

(Continued)

OTHER PUBLICATIONS

William Wilcke and R. Vance Morey, Natural-Air Corn Drying in the Upper Midwest, http://www.extension.umn.edu/agriculture/com/harvest/natural-air-corn-drying/, Copyright © 2009 Regents of the University of Minnesota. All rights reserved. WW-6577-GO 1995; Review 2009.

*Primary Examiner* — Kenneth Rinehart
*Assistant Examiner* — John McCormack
(74) *Attorney, Agent, or Firm* — Mark A. Litman & Associates, P.A.

(57) ABSTRACT

A bin and method of use for containment and delivery of particulate materials has:

a) a housing;
b) a particulate materials support plate within the housing, the support plate having a porous structure allowing air flow therethrough;
c) the support plate having a central area elevated away from the bottom of the housing and surrounding sides;
d) an air flow area between the bottom of the housing and the support plate;
e) a particle drop region surrounding the sides of the support plate; and
f) a sealing and opening component within the particle drop region that seals and opens a particle drop path between the support plate and the side walls of the housing.

The sealing and opening component has an expanded position when sealing the particle drop region and is in a retracted position when opening the particle drop region to particulate material passage.

20 Claims, 5 Drawing Sheets

(51) Int. Cl.
*F26B 25/00* (2006.01)
*F26B 25/10* (2006.01)

(56) References Cited

U.S. PATENT DOCUMENTS

| | | | | |
|---|---|---|---|---|
| 4,361,254 | A * | 11/1982 | Teraoku | B65D 88/28 141/331 |
| 8,556,225 | B2 * | 10/2013 | Gray | A61M 5/14224 251/61.1 |
| 2003/0132241 | A1 | 7/2003 | Treat | |
| 2006/0107587 | A1 | 5/2006 | Bullinger et al. | |
| 2006/0236925 | A1 | 10/2006 | Lund | |
| 2009/0302065 | A1 | 12/2009 | Winsor | |
| 2012/0230778 | A1 | 9/2012 | Petit et al. | |
| 2015/0208670 | A1 * | 7/2015 | Lekner | A21C 1/065 366/77 |

* cited by examiner

Natural-air drying bin equipped with grain spreader, exhaust vents, fan and full-perforated floor.

BIN SYSTEM AND METHOD OF REGULATING PARTICULATE FLOW FROM BINS

BACKGROUND OF THE INVENTION

1. Field of the Invention

The present invention relates to the field of storage or processing bins for particulate materials and for processes for removing the particulate materials from the bins. Bin structures, methods of use of the bins and methods of removing particulate materials from the bins are enabled.

2. Background of the Art

Bins are used in a wide range of technologies to store, treat, deliver and dry particulate materials. Typically bins are used with particles having average sizes of at least one millimeter (1 mm), and preferably with more moderate size particles of from 1-100 millimeters, and more particularly from number average particle size diameters of from 20-50 millimeters and more particularly from 4-40 millimeters.

Bins are used in mining industries, waste storage and disposal technologies, recycling industries, pharmaceutical technologies, particle drying technologies, plastic molding industries, agricultural technologies and especially in the grain industries. Bins are commonly seen on farms, farm cooperatives, commercial agricultural operations, ethanol and biodiesel manufacturing plants and industrial processing plants where grains (e.g., rice, oats, wheat, barley, soy beans, corn, hops, and the like) are stored for treatment, delivery, feedstock or processing.

Bins may be minimally functionalized, with only systems for filling and emptying the bin, or may contain more detailed functionality such as sensing devices, components responsive to the sensing devices, drying systems, stirring systems, leveling systems and air flow systems, as well as emptying and filling components. In certain industries, such as manufacturing and particle treatment, bins may be provided with chemical application components and fluid bed support components.

Many studies have been made about the properties and efficiency of agricultural bins, including air-drying bins as in "Natural-Air Corn Drying in the Upper Midwest," William Wilcke and R. Vance Morey, University of Minnesota, which is incorporated herein by reference. Natural-air drying is basically a race between drying progress and growth of the fungi (commonly called molds) that cause grain spoilage. The bin is usually filled in a few days and the fan is started as soon as bin filling begins. Drying takes place in a one- to two-foot thick drying zone (also called a drying front) that moves slowly up through the bin (FIG. 1). Grain below the zone is generally dry enough to be safe from spoilage, while grain above the zone remains at its initial moisture until the zone passes. (Note that positive pressure, or upward airflow, is recommended for natural-air drying so that wet grain is at the top of the bin. There it is easier to watch for signs of mold and to move moldy corn out of the bin if necessary.) It is to be noted that no mechanism for grain removal is provided.

High temperature drying is done either in the bin or in a dryer. There are four approaches to high temperature drying: in-bin batch drying, recirculating bin drying, continuous flow bin drying, and pass drying. In-bin batch drying is similar to natural airflow temperature drying except that air temperatures are often 120°–160° F. and air flow rates are from 8 to 15 cfm/bushel. Drying time is greatly reduced with high temperature drying. However, grain near the floor often becomes excessively dried while the top layer of grain often stays moist. Stirring devices provide more uniform drying and should be considered in conjunction with this method. Stirring also allows for increased batch depth (7 to 8 feet).

Recirculating bin dryers (FIG. 2, Prior Art) are bins that are filled with grain and then the fans and heat are turned on. There is a sweep auger in the bottom of these bins that is activated by temperature or moisture sensors. When a target condition is met, the sweep auger makes one full pass and stops when those conditions are met again. Grain discharged by the sweep auger is placed onto the top of the grain within the bin. There may be some rewetting of dried grain.

Published US Patent Application Document No. 20060107587 (Bullinger) describes a heat treatment apparatus like a fluidized-bed dryer for heat treating a particulate material in a low temperature, open-air process. Preferably, available waste heat sources within the surrounding industrial plant operation are used to provide heat to the dryer. Moreover, conveyor means contained within the dryer can remove larger, denser particles that could otherwise impede the continuous flow of the particulate material through the dryer or plug the fluidizing dryer.

Published US Patent Application Document No. 20120230778 (Petit) discloses a device for transporting powder comprising a conveyer, which includes a lower channel in which a gas circulates, and an upper channel, designed for the circulation of powder and said gas, said lower channel and said upper channel being separated by a porous wall that said gas can pass through, the lower channel being supplied with gas at a pressure allowing the potential fluidization of said powder in said upper channel, said upper channel being provided in its upper part with transverse walls placed so that they delimit with the upper wall of said upper channel at least one upper zone in which a gas bubble under pressure is formed as a result of putting said air chute under potential fluidization pressure. At the level of at least one bubble so formed, the wall of the upper channel includes a means of removal for fluidization gas provided with a means of creating pressure drop, which creates a substantially constant pressure drop.

Published US Patent Application Document No. 20090302065 (Winsor) discloses a device for urging bulk material to flow from a hopper such as the hopper of a railway car. The device includes a rotating axle that can be rotated by a power wrench, and one or more rotating agitators having auger coils disposed near the bottom outlet of a hopper and which are rotatably connected to the axle. Rotating the axle causes the agitators to rotate, thereby breaking up and urging bulk material to flow downward through the bottom outlet. Also disclosed is a system for emptying a hopper such as the hopper of a railway car, wherein a device with rotatable agitators having auger coils is integrated with a sliding gate assembly situated at the bottom outlet of the hopper. A power wrench can be used both to open and close the gate assembly, and to rotate the agitators in the hopper so as to break up and urge bulk material downward and out of the hopper through the opened gate assembly.

Published US Patent Application Document No. 20060236925 (Lund) discloses apparatus directed toward a modular seed treatment apparatus that is capable of receiving various component pieces of equipment for application of liquid treatment compositions and powders to seeds on a frame assembly to accommodate the various component pieces. The apparatus is further directed toward a modular seed treatment apparatus that is capable of receiving a treatment container for treatment of various small quantities of seed including 0.5 to two pounds, two to five pounds and 5 to 10 pounds of seed.

Published US Patent Application Document No. 20030132241 (Treat) discloses an externally-mounted, quick-acting trigger assembly for firing blast aerators, air cannons, or the like. The trigger assembly is ideal for high temperature applications involving environmental factors such as excessive heat, humidity, and mechanical shock. The trigger comprises a symmetrical, ventilated housing that internally mounts a hollow piston. A plurality of vent orifices are radially disposed about the housing periphery, and normally covered by a resilient band forming a check valve. The trigger piston comprises a generally cylindrical base and an integral, generally conical bottom that is displaced into and out of contact with a mechanical valve seat. An air passageway through the piston is controlled by a deflectable spherical valve element that is captivated within the piston, for selectively blocking air passage through the piston by contacting an internal valve seat. This construction with internal air passageways facilitates trigger function. The base comprises a circumferential groove for seating an appropriate O-ring. When air is introduced into a conventional inlet port, a diaphragm is forced onto an exhaust seat.

All information cited herein, including patents and applications, are incorporated herein by reference in their entirety.

SUMMARY OF THE INVENTION

A bin and its method of use for containment and delivery of particulate materials has:

a) a housing comprising a top, a bottom and side walls;
b) a particulate materials support plate within the housing, the support plate having a porous structure allowing air flow through the support plates;
c) the support plate having a central area elevated away from the bottom of the housing and surrounding sides;
d) an air flow area between the bottom of the housing and the support plate;
e) a particle drop region surrounding the sides of the support plate; and
f) a sealing and opening component within the particle drop region that seals and opens a particle drop path between the support plate and the side walls of the housing.

The sealing and opening component has an expanded position when sealing the particle drop region and is in a retracted position when opening the particle drop region to particulate material passage.

BRIEF DESCRIPTION OF THE FIGURES

FIG. 5 B shows a second sealing mechanism between a bin wall and the sloped central grain support within the bin.

FIG. 5 C shows a third scaling mechanism between a bin wall and the sloped central grain support within the bin.

FIG. 5 D shows a fourth sealing mechanism between a bin wall and the sloped central grain support within the bin.

FIG. 5 E shows a fifth sealing mechanism between a bin wall and the sloped central grain support within the bin.

DETAILED DESCRIPTION OF THE INVENTION

Figure 1:
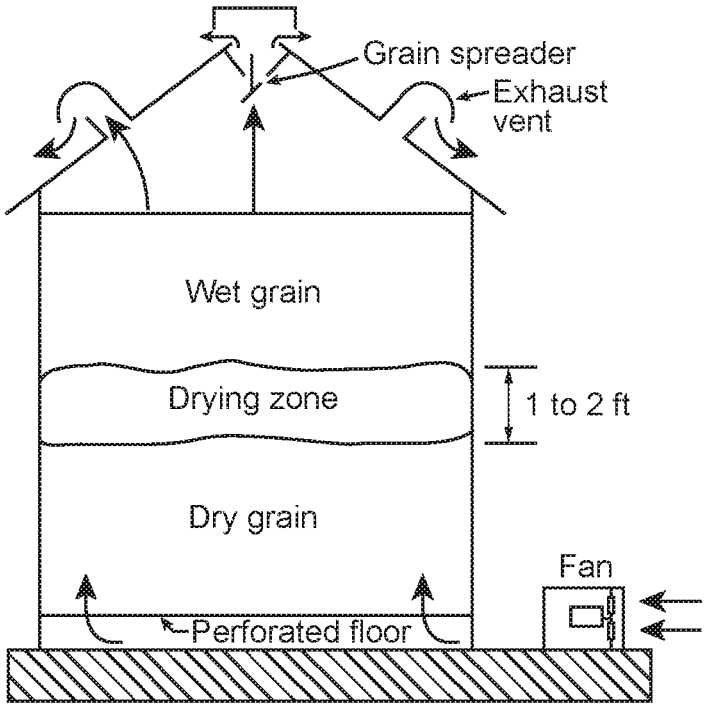
FIG. 1 (Prior Art)
FIG. 1 shows (Prior Art) a natural-air drying bin equipped with grain spreader, exhaust vents, fan, and full-perforated floor provided from Wilcke and Morey.
Figure 2:
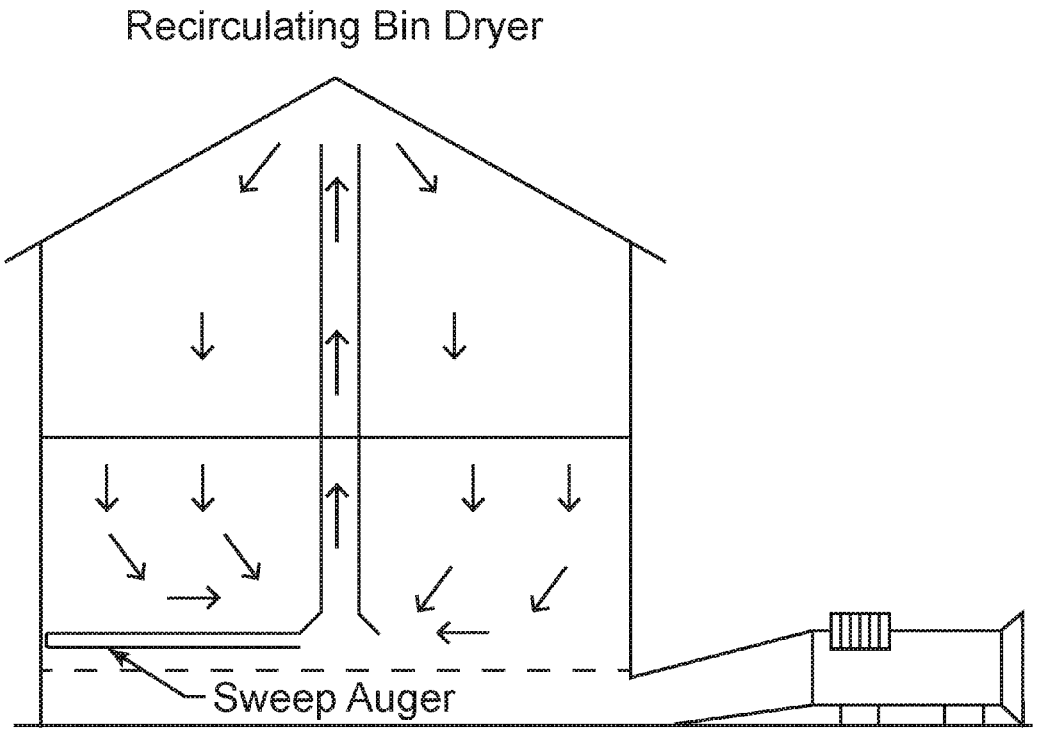
FIG. 2 (Prior Art)
FIG. 2 shows a schematic of a prior art recycling air dryer bin.

The present technology includes a bin (or any other solid storage container) for containment and delivery of particulate materials. The bin may store, and possibly treat the particulate materials within the bin. The bins are designed for particulates having a number average diameter size. The individual bins may be modified to contain specific ranges of particle materials, as will be discussed herein. The bin may have:

a) a housing comprising a top, a bottom and side walls;

The housing is made of structural materials sufficient to operate under the stress of use. This stress includes all of physical stress, strain, weight, chemical contact, organic contact and vibration as well as ambient conditions (including weather if used outdoors). Typical structural materials would include metals (such as carbon steel, high strength low alloy steel, stainless steel and aluminum), polymeric materials, ceramics, wood (primarily for framing) and composites.

b) s particulate materials support surface structure (hereinafter referred to as a "plate", although any structural support surface with the porosity defined herein is acceptable, e.g., sheeting, plate, panel, grill, grating, loovers, and the like) within the housing positioned towards the bottom of the housing, the support plate having a porous structure allowing air flow through the support plate, pores in the porous structure having diameters smaller than the number average size diameter of the particulate materials;

As noted herein, the particulate materials address may vary over a significant range of number average diameter sizes. The particles are distinguished from powders by a minimum size of 0.5 millimeters, preferably at least 1.0 millimeters. To differentiate from more substantive articles of manufacture, the particulates typically have a maximum diameter of 100 millimeters (0.1 meters). The particulates may be brittle, hard, flexible, porous, organic, composite, natural (e.g., grains), synthetic (e.g., agricultural or pharmaceutical pellets or grains), metallic and the like. The particulate material should have at least a sufficient specific gravity so as to be easily moved against contact-induced friction between particles, such as a specific gravity of at least 0.3. There is no reason to limit upper limits of density.

c) the support plate having a central area elevated away from the bottom of the housing and surrounding sides;

The elevation of the center area creates a flow pattern for the particulate materials towards the surrounding sides which lead to the drop area through which the particulate material exits the central area of the housing, such as the storage volume within the bin. The elevation may be a peak of a spherical shape (up to but no more than a hemisphere), a pyramidal shape, conical shape, or other geometric shape such as a curved face (preferably convex curve) pyramidal shape or other shape that provides a slope from the peak of the elevation to the surrounding sides. The plate should be made of a strong structural material that can support the significant weight of the grain filling (the particulate material). Metals (especially chrome steel, carbon steel, high strength low alloy steel, stainless steel, aluminum and the like), composites, ceramics, polymeric materials (especially reinforced polymers, such as filament and fiber reinforced polymers) and the like.

d) an air flow area between the bottom of the housing and the support plate;

The air flow area should be of sufficient size and volume as to allow free flow of gases, especially air or heated air through the air flow area and then through the support plate, which has a porous structure. A pump of pressurized system would be associated with an input area for the flow of gases. If heating or chemistry is added to the air flow, systems for introducing the chemistry or adding heat must be provided.

e) a particle drop region surrounding the sides of the support plate;

The particle drop region is a pathway (opening) around the sides of the support plate through which the particulate material will flow when the particle drop region is open. The particles flow both downward from collected particulate matter volume above the drop region and along the slope of the support plate. The slope at the end of the sides should exceed at least 10°, more preferably at least 20°, greater than 30-40° and most preferably more than 60° to maximize ease of flow at the sides into the drop region. The top of the elevated center of the support plate may be relatively flat, but should not be concave. Minimizing and physical barriers within the drop area (e.g., supports, structural elements, and the like) is beneficial to the design to improve uninterrupted flow through the drop zone. The particle drop region provides an opening about the sides of the support plate through which the particles can pass. Many structural features may be provided within or before the particle drop area to facilitate controlled delivery of particulates and controlled flow of particulates from within the housing. There is a desire to assure that the particulates are delivered from the volume on a relatively first-infirst-out basis, with the level of the mass of particulates moving downwardly at a similar rate at all points on its surface. The elevated center of the support plate is one feature that assists in this benefit. Vanes, series of vanes, or skirts around the interior walls of the housing can also assist in directing equal level drop of the particulates.

f) a sealing and opening component within the particle drop region that seals and opens a particle drop path between the support plate and the side walls of the housing;

The sealing and opening component controls the flow or non-flow of the particulate materials from a storage volume within the housing into the drop zone and then to an exit from the bin. The drop zone may lead to a particulate movement system or transportation system that carries or moves the particulate materials out of and away from the housing. All forms of transportation systems, including moveable bin loading, funneling, fluid driven transports, mechanical movement systems, vacuum systems, auger driven movement and the like are useful in transporting particulates.

wherein the sealing and opening component is in an expanded position when sealing the particle drop region against particulate material passage and is in a retracted position when opening the particle drop region to particulate material passage.

The bin may have the support plate connected with a motorized vibrator to vibrate the support plate. The vibration helps to break up any agglomeration of particulate material, assists in reducing friction of the particulates to the support plate. The vibration, along with gas flow through the pores or holes in the support plate, also helps dislodge any particulates embedded in the holes. As previously noted, there may be a heating element associated with the air flow area. It would be typical for the side walls to form a circular housing and for the support plate to be generally circular. Other geometric shapes may be used, but for simplicity of design and operation, more rounded forms are desired. The support plate may also be rotated about a central axis to assist in moving and dislodging particulates. The rotation may be reversible and pulsed to improve its performance, and grooves or blades may extend from the sides to assist in material dislodging and movement.

The sealing and opening component may be extendable by fluid pressure applied to an interior of the component or by mechanical extension. For example, the sealing and opening component may have an annular shape and is extendable by fluid pressure applied to an interior of the component, such as where the sealing and opening component comprises an elastomeric element having an interior volume, the elastomeric element extends upon application of fluid to the interior volume and retracts upon removal of fluid from the interior volume. The elastic may be reinforced or may alternatively operate in a telescoping, or parachute deploying manner to fill at least a continuous line around the support plate and between the support plate and the sides of the housing. The expanded or extended sealing and opening component should be able to conform and close a continuous area within the drop area to prevent particulate flow downward. The material of the sealing and opening component should therefore be able to conform to the sides of the support plate and the interior walls of the housing or an extension from those walls to define a sealing zone (e.g., such as a rib or extending plate forming a circumference around the walls of the housing and opposed to the sides of the support plate or a drop plate below the sides of the support plate.

The material may be elastomeric, elastic, reinforced polymer sheeting and the like, forming an annular structure that creates the seal or assists in forming the seal. The annular structure may be an expandable diaphragm around the edges or drop plate from the sides of the support plate, or it may deploy from within a cavity at the edge or in the drop plate and then (in being retracted to the open position) be withdrawn back into the cavity to open up the drop area.

The sealing and opening component comprises an elastomeric element that may have an interior volume, and the elastomeric or deployable element extends upon application of fluid to the interior volume and retracts upon removal of fluid from the interior volume. The fluid may be air, water, gas or liquid. The component may have cells, ribs or other structural elements within the volume to add structural strength to the component. The application of fluid into the interior volume may be controlled by a pump that enables pulsed pressure to be applied to the sealing and opening component. The sealing and opening component and the housing may be associated with sensors such as internal sensors (e.g., fluidic pressure sensors, temperature sensors) or external sensors (e.g., elastomeric piezoresistive sensors) to provide signals and information relating to the state of deployment, degree of expansion, degree of material elongation, internal pressure, temperature, pH, humidity, volatile organic materials, odors and other conditions that might be important to the storage or delivery of the particulate materials. A processor would receive the signals or data transmissions, process the signals according to stored software, interpret the signals as indicative of an existing or changing condition, and then transmit its own signals or commands to components to respond to the sensed conditions. For example, if undesirably high levels of humidity at specific locations are within the housing, the air flow and heating of the air flow can be adjusted to address or ameliorate that condition. Detection of adverse conditions early in their development can assist in minimizing permanent damage to the bin or to its contained material.

The bin of the present technology would be particularly useful for the storage, containment, conditioning, drying and delivery of agricultural grains within the housing, especially where there is a heating element associated with the air flow area.

The technology of the present invention also provides significant safety features in the use of the bins, where agricultural accidents are too commonplace. The area where safety is enhanced includes:

Elimination of unloading grain vortex. In common designs, where there is a direct and single feed of grain to a single outlet, a vortex is often created within the volume of grain as it empties. This creates a significant safety aspect.

Moving the grain toward the outside of the bin to remove the gran, without creating a vortex by using only a single relatively vertical spout or angled chute is yet another benefit of our system. Sadly, every year there are numerous suffocations caused by grain bins during the unloading process; it is the leading cause of death associated with grain storage bins.

For example, in 2010, 51 workers were engulfed by grain stored in bins, and 26 died—the highest number on record, according to OSHA. Suffocation occurs when a worker becomes buried (engulfed) by grain as they walk on moving grain or attempt to clear grain built up on the inside of a bin.

Moving grain acts like "quicksand" and can bury a worker in seconds. The behavior and weight of the grain make it extremely difficult for a worker to get out of it without assistance.

The present design also, as explained herein allows removal of both only dry grains from the bin bottom and coincident First-in, first-out material handling.

A method for storing and delivering particulate materials according to the present technology using a bin as described herein may include the following types of steps. The bin would be:

a) a housing comprising a top, a bottom and side walls;

b) s particulate materials support plate within the housing positioned towards the bottom of the housing, the support plate having a porous structure allowing air flow through the support plate, pores in the porous structure having diameters smaller than the number average size diameter of the particulate materials;

c) the support plate having a central area elevated away from the bottom of the housing and surrounding sides;

d) an air flow area between the bottom of the housing and the support plate;

e) a particle drop region surrounding the sides of the support plate; and f) a sealing and opening component within the particle drop region that seals and opens a particle drop path between the support plate and the side walls of the housing;

wherein the sealing and opening component is in an expanded position when sealing the particle drop region against particulate material passage and is in a retracted position when opening the particle drop region to particulate material passage. The method could include adding the particulate materials into the housing while the sealing and opening component is in an expanded position sealing the drop region against passage of particulate material; and removing at least some particulate material from the housing by retracting the sealing and opening component and allowing at least some particulate material to pass through the drop region into a particulate material exit from the housing.

A motorized vibrator may vibrate the support plate to assist movement of particulate materials over an upper surface and down a slope of the support plate. In the treatment of particulate materials, especially in the drying of the particulates and especially agricultural grains, heated air is moved through the air flow area, upward through the support plate and out of the top of the housing.

Further appreciation of the present technology will be obtained through a view of the figures. Identical numbers represent identical or similar elements in the figures.

Figure 3:
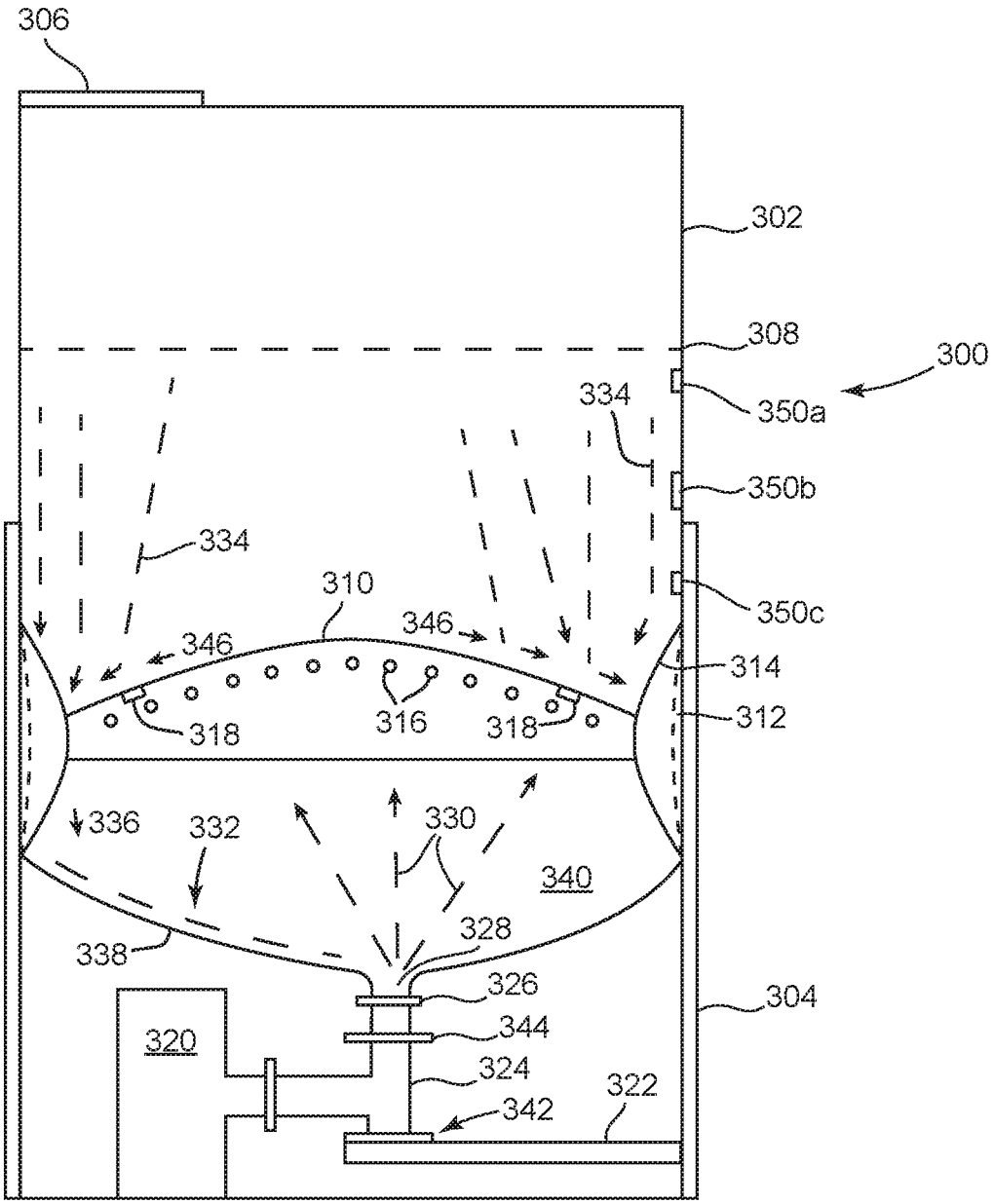
FIG. 3 shows a schematic of a bin according to the present technology.

FIG. 3 shows a side schematic of a grain drying and delivery bin 300 according to aspects of the present technology. The bin 300 has top sides 302, lower reinforcing sides 304, particulate (e.g., grain) entry hatch 306, a relative grain level 308 within the bin 300 and the sloped central grain support element 310. The sloped central grain support element 310 is shown with openings 316 which allow upward air flow (for drying and/or conditioning) yet are small enough to prevent the particulates from passing through the support 310. Dashed lines show a non-inflated diaphragm 312 and an inflated diaphragm 314 engaging the sides 308 of the bin 300. Particulate flow 334 passes down 336 past sides of the sloped central particulate support 310 along a further path 332 on a particulate carrying surface 338 which is shown as circular funnel-shaped, but may be truncated pyramidal with 3, 4, 5, 6, etc. sides to simplify construction costs. The particulates flow down path 328 into carrying pipe 324 down to a particulate carrying system 322 (e.g., which may be a conveyor, or other particulate moving system (e.g., air flow, fluidized flow, gravity flow, etc.). A fluid moving apparatus (fan, pump, etc.) for fluid moving (e.g., air liquid moving) or fluid moving and heating element 320 is shown. It is possible to dry or condition the particulates by this fluid movement, with or without heating. Fluid moved by the fluid moving apparatus 320 can pass up through the carrying pipe 324 into the volume 340 where its movement 330 upward passes into the sloped central particulate (grain) support element 310 and out of the openings 316 and into the particulates. Manually operated or processor controlled electromechanical controls on a series of flow and pressure and direction control valves 326, 342 and 344 control relative flow of air and grain during various operations of the system. For example, when the inflated or extended annular sealing element 314 is retracted or distended to its form 312, particulates will flow downward from the level 308 against the sloped central grain support element 310 as along paths 334 and then move as shown across the top of the sloped central grain support element 310 along paths 346. The slope of the paths 346 may be steeper or not, linear or (as shown) curved. When the annular sealing element 314 is in an extended position, there is no flow of particulates and upward air flow along paths 330 passes through holes 316 to dry or condition the particulates. Materials (chemistry, coating materials, pharmacological materials, pest control agents and the like may be introduced with the fluid flow, driven by the fluid moving apparatus 320. When the annular sealing element 314 is in a retracted position, there is flow of particulates and it is optional whether or not there is upward air flow along paths 330 passes through holes 316 to dry or condition the particulates. Also shown in FIG. 3 are vibrators 318 for causing vibrations on the top of the sloped central grain support element 310 to assist in moving vertical dropping particulates along paths 346 on demand or at regular intervals during movement of particulates. Three sensors 350*a*, 350*b* and 350*c* are shown which can sense any desired condition such as temperature, humidity, pressure, chemicals (which might indicate any undesired contamination as by accidental chemical introduction, excess chemical introduction, release from microbes such as bacteria, virus or fungus), excess dust and any other condition that can be physically, chemically or electronically sensed and might be of import to the particulates in the bin.

Figure 4:
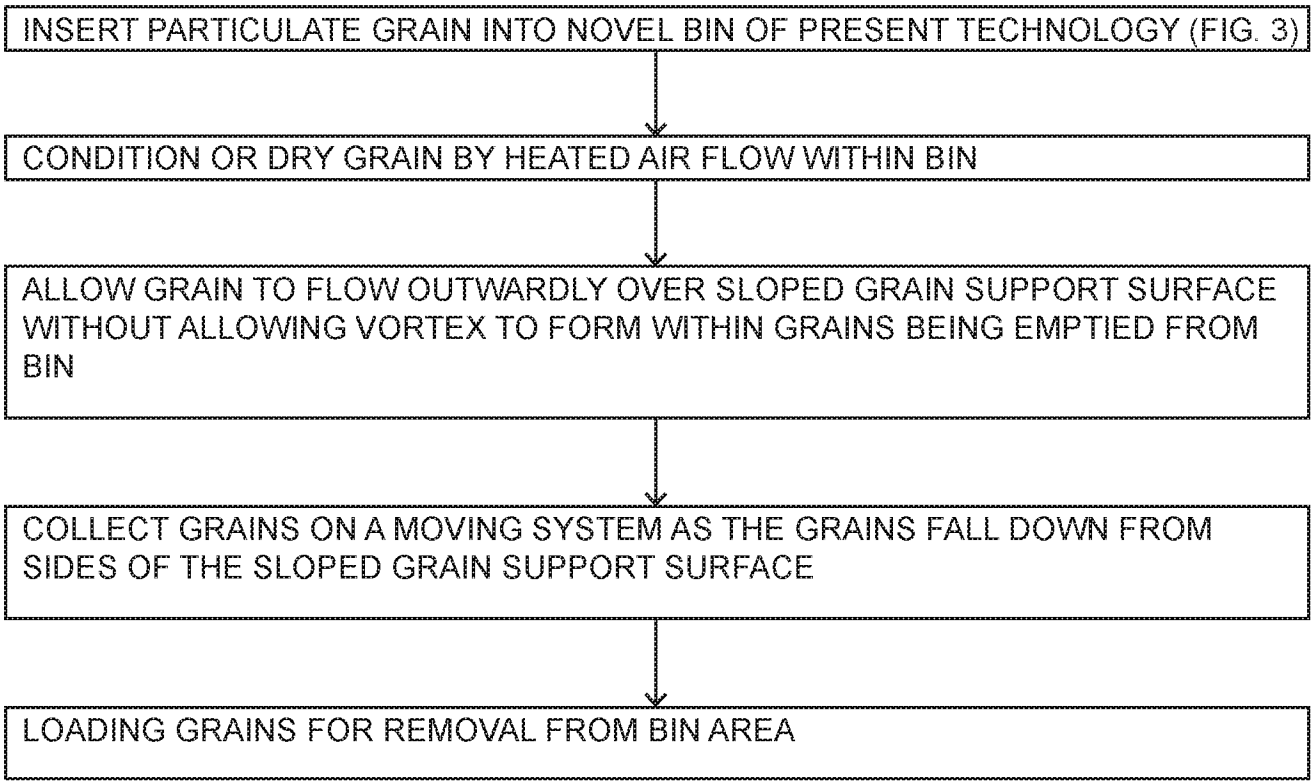
FIG. 4 is a flow diagram of the method of use of the present technology.
Figure 5A:
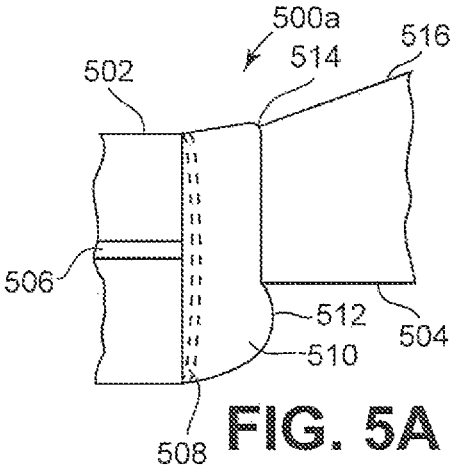
FIG. 5 A shows a first sealing mechanism between a bin wall and the sloped central grain support within the bin.
Figure 5B:
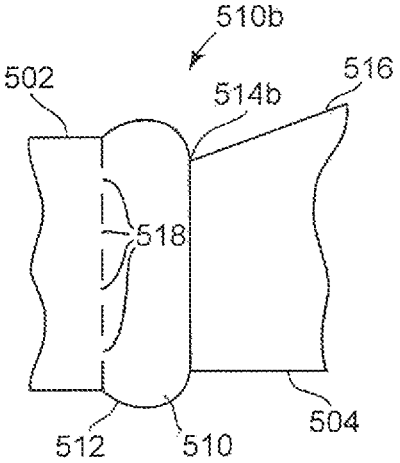
Figure 5C:
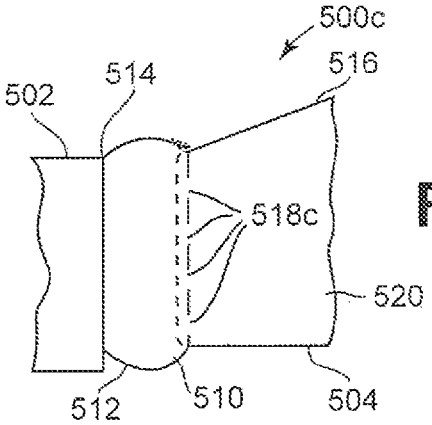
Figure 5D:
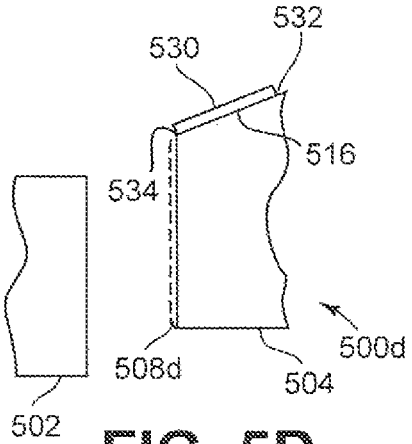
Figure 5E:
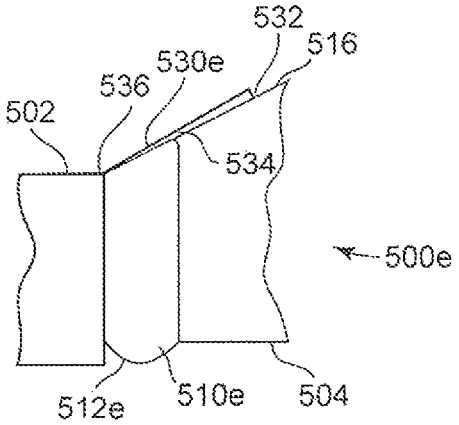

FIG. 4 is a flow diagram of a method of use of the present technology.

FIG. 5 A shows a first sealing mechanism 500*a* between a bin wall extension 502 and the sloped central grain support 504 within the bin. In this configuration of the first sealing mechanism 500*a* an unexpanded annular element 508 is shown with a fluid delivery tube 506 directed towards the unexpanded annular element 508. Fluid is delivered through fluid delivery port 506 into the unexpanded annular element 504, a volume 510 is created within an expanded annular element 512. The expanded annular element 512 contacts the sloped central grain support 504 and forms a seal 514 beginning at the end of the downward slope 516 of the sloped central gain support 504.

FIG. 5 B shows a second sealing mechanism 500*b* between a bin wall extension 502 and the sloped central grain support 504 within the bin. In this sealing mechanism 500*b*, the volume 510 is created within the expanded annular element 512 through fluid passage through a series of openings 518 The sloped top surface 516 is shown at an elevation slightly below the top of an extension from the side wall 502 of the bin. The expanded annular element 512 forms a slightly overlapping seal 514*b* with the sloped top central grain support 615.

FIG. 5 C shows a third sealing mechanism 500*c* between a bin wall extension 502 and the sloped central grain support 504 within the bin. In this mechanism 500*c*, the unexpanded annular element 508*d* extends from the sloped central grain support 504 with fluid provided from within cavity 520 through openings 518*c* in the sloped central grain support so that the expanded annular element 512 extends from the sloped central grain support 504 towards and against the bin wall extension 502. The expanded seal 514*c* is here present against the bin wall extension 512.

FIG. 5 D shows a fourth sealing mechanism 500*d* between a bin wall extension 502 and the sloped central grain support 504 within the bin. A mechanically extending (telescoping of fan extension) component 530 having a secured position 532 on the top slope 516 and a roller or bearing 534 so that extension of the mechanically extending element 530 is facilitated. An unexpanded annular element 508*d* (optional) is shown in combination with the mechanically extending component 530.

FIG. 5 E shows a fifth sealing mechanism 500*e* between a bin wall extension 502 and the sloped central grain support 504 within the bin. The mechanically extending element 530*e* is in an extended position forming an overlap seal 536 against the top of the bin wall extension 502. The optional annular expanding element in an expanded position 512*e* with a fluid expanded interior volume 510*e* is shown. With a combination of both the expanded annular element 512*e* and the extended mechanically extending element 530*e* and strong support of the grain seal is created with redundant and enhanced capability.

What is claimed:

1. A bin for containment and delivery of particulate materials having a number average diameter size comprising:

a) a housing comprising a top, a bottom and side walls;

b) a particulate materials support plate within the housing positioned towards the bottom of the housing, the support plate having a porous structure allowing air flow through the support plate, pores in the porous structure having diameters smaller than the number average size diameter of the particulate materials;

c) the support plate having a central area elevated away from the bottom of the housing and surrounding sides;

d) an air flow area between the bottom of the housing and through the support plate;

e) a particle drop region surrounding the sides of the support plate; and f) a sealing and opening expandable annular component within the particle drop region that when expanded seals a particle drop path and when unexpanded opens the particle drop path between the support plate and the side walls of the housing;

wherein the sealing and opening expandable annular component is in an expanded position when sealing the particle drop region against particulate material passage and is in a retracted position when opening the particle drop region to particulate material passage.

2. The bin of claim 1 wherein the support plate is connected with a motorized vibrator to vibrate the support plate.

3. The bin of claim 1 having a heating element associated with the air flow area and wherein the expandable annular component comprises an elastomeric material.

4. The bin of claim 1 wherein the side walls form a circular housing and the support plate is circular and wherein the sealing and opening expandable annular component comprises an elastomeric material around the support plate.

5. The bin of claim 1 wherein the sealing and opening expandable annular component is expandable by fluid pressure applied to an interior of the component.

6. The bin of claim 1 wherein the sealing and opening annular expandable component has an annular shape and is expandable by fluid pressure applied to an interior of the component.

7. The bin of claim 5 wherein the sealing and opening annular expandable component comprises an elastomeric element having an interior volume, the elastomeric element expands upon application of fluid to the interior volume and retracts upon removal of fluid from the interior volume.

8. The bin of claim 6 wherein the sealing and opening expandable annular component comprises an elastomeric element having an interior volume, the elastomeric element expands upon application of fluid to the interior volume and retracts upon removal of fluid from the interior volume.

9. The bin of claim 7 wherein the application of fluid into the interior volume is controlled by a pump that enables pulsed pressure to be applied to the sealing and opening expandable annular component.

10. The bin of claim 9 wherein the support plate is connected with a motorized vibrator to vibrate the support plate.

11. The bin of claim 1 containing agricultural grains within the housing and having a heating element associated with the air flow area.

12. The bin of claim 1 wherein the support plate has a shape by having a central area elevated away from the bottom of the housing and surrounding sides, the shape reducing potential for formation of a vortex during downward particulate removal from the bin.

13. The bin of claim 7 wherein the support plate has a shape by having a central area elevated away from the bottom of the housing and surrounding sides, the shape reducing potential for formation of a vortex during downward particulate removal from the bin.

14. A method for storing and delivering particulate materials using a bin comprising:

a) a housing comprising a top, a bottom and side walls;

b) a particulate materials support plate within the housing positioned towards the bottom of the housing, the support plate having a porous structure allowing air flow upwardly through the support plate, pores in the porous structure having diameters smaller than the number average size diameter of the particulate materials;

c) the support plate having a central area elevated away from the bottom of the housing and surrounding sides;

d) an air flow area between the bottom of the housing and through the support plate;

e) a particle drop region surrounding the sides of the support plate; and f) sealing an opening region and opening the opening region within the particle drop region to respectively seal and open a particle drop path between the support plate and the side walls of the housing to respectively allow particles to flow downward through the opening and prevent particles from flowing downward through the opening;

wherein the sealing and opening is performed by expanding a sealing and opening expandable annular component when sealing the particle drop region against downward particulate material passage and the expandable annular sealing component is in a retracted position when opening the particle drop region to downward particulate material passage, the method further comprising adding the particulate materials into the housing while the sealing and opening component is in an expanded position sealing the drop region against passage of particulate material; and removing at least some particulate material from the housing by retracting the sealing and opening expandable annular component and allowing the at least some particulate material to pass through the drop region into a particulate material exit from the housing.

15. The method of claim 14 wherein a motorized vibrator vibrates the support plate to assist movement of particulate materials over an upper surface and down a slope of the support plate.

16. The method of claim 14 wherein heated air is moved through the air flow area, upward through the support plate and out of the top of the housing.

17. The method of claim 16 wherein the particulate materials comprise agricultural grain and grain is dried by the upward air flow of heated air through the support plate within the bin before it exits the housing.

18. The method of claim 14 wherein the shape of the support plate, by having a central area elevated away from the bottom of the housing and surrounding sides, reduces potential for formation of a vortex during downward particulate removal from the bin.

19. The method of claim 16 wherein the shape of the support plate, by having a central area elevated away from the bottom of the housing and surrounding sides, reduces potential for formation of a vortex during downward particulate removal from the bin.

20. The method of claim 17 wherein the shape of the support plate, by having a central area elevated away from the bottom of the housing and surrounding sides, reduces potential for formation of a vortex during downward particulate removal from the bin and upward flow of heated air through the support plate.

* * * * *